United States Patent [19]

Corman et al.

[11] 3,955,619

[45] May 11, 1976

[54] HEAT TRANSFER DEVICE

[75] Inventors: James C. Corman, Scotia; Gunnar E. Walmet, Schenectady, both of N.Y.

[73] Assignee: General Electric Company, Schenectady, N.Y.

[22] Filed: Mar. 11, 1974

[21] Appl. No.: 449,744

Related U.S. Application Data

[62] Division of Ser. No. 307,118, Nov. 16, 1972, abandoned, Division of Ser. No. 124,805, March 16, 1971, Pat. No. 3,746,081.

[52] U.S. Cl. ..... 165/105; 62/285; 165/110

[51] Int. Cl.[2] ..... F28D 15/00

[58] Field of Search ..... 165/105, 110; 62/285

[56] References Cited

UNITED STATES PATENTS

| | | | |
|---|---|---|---|
| 3,305,005 | 2/1967 | Grover et al. | 165/105 |
| 3,587,725 | 6/1971 | Basiulis | 165/105 X |
| 3,656,545 | 4/1972 | Loo | 165/105 X |
| 3,666,005 | 5/1972 | Moore, Jr. | 165/105 |

*Primary Examiner*—Albert W. Davis, Jr.
*Attorney, Agent, or Firm*—Paul R. Webb, II; Joseph T. Cohen; Jerome C. Squillaro

[57] ABSTRACT

In a heat pipe the portion of the wicking material which receives the liquid condensed at the condenser surface at the heat output end of the heat pipe is provided with a plurality of large openings extending from the surface adjacent the condenser surface to the opposing surface thereof to avoid condensate accumulation adjacent the condensation surface. Such accumulation blocks access of the condensation surface to vapor and hence increases the thermal impedance of the heat output end of the heat pipe.

3 Claims, 9 Drawing Figures

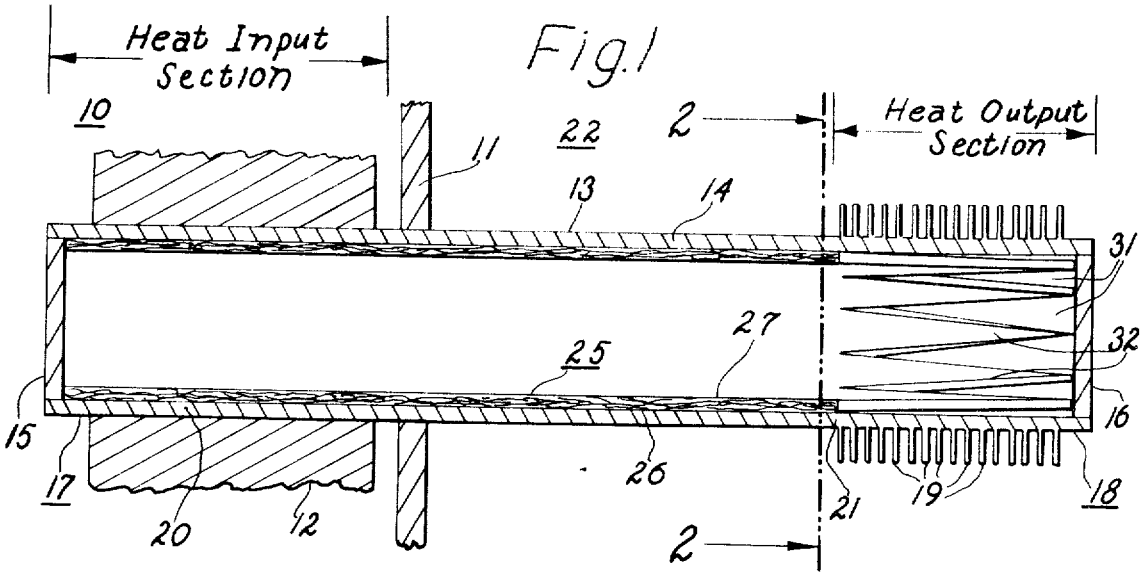
Fig. 1
Fig. 2
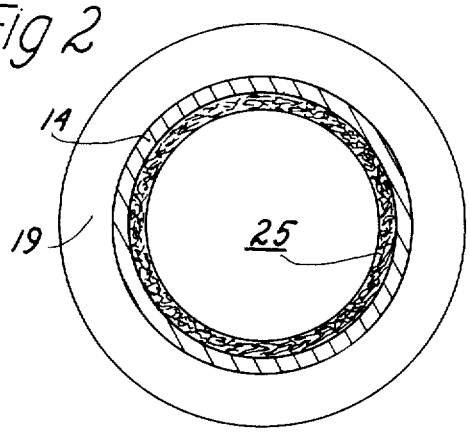
Fig. 3
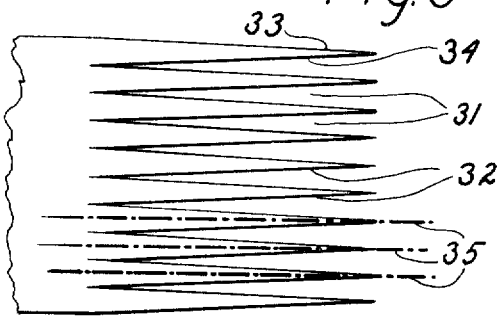
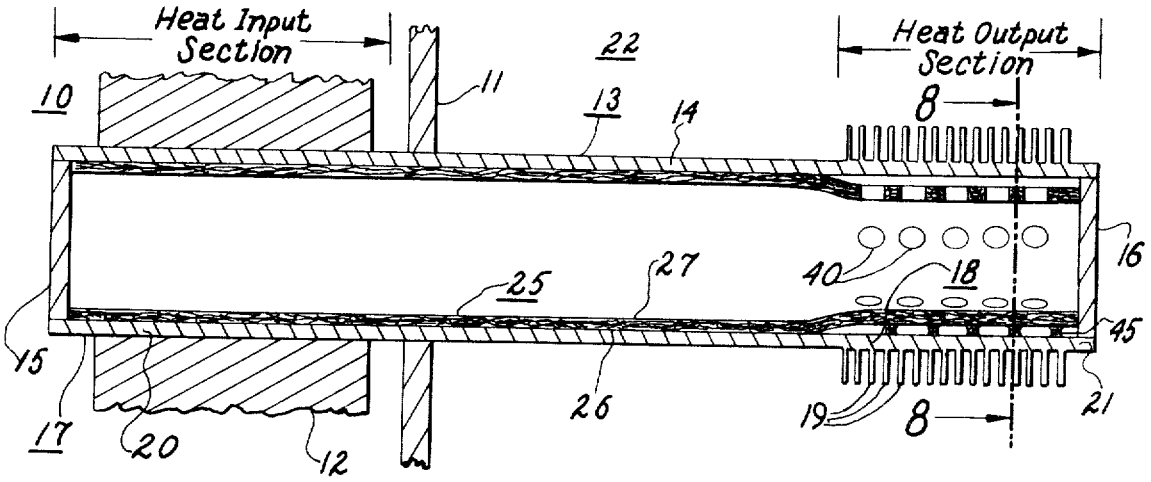
Fig. 7

HEAT TRANSFER DEVICE

This is a continuation of patent application Ser. No. 307,118, filed Nov. 16, 1972, now abandoned; said patent application Ser. No. 307,118 being a division of patent application Ser. No. 124,805, filed Mar. 16, 1971; said patent application Ser. No. 124,805 having now matured as U.S. Pat. 3,746,081.

The present invention relates, in general, to a heat transfer device involving the condensation of a vapor supplied to a heat transfer surface of the device and absorption of condensate formed thereon by a wicking means adjacent thereto, and in particular to heat pipes utilizing such devices.

A heat pipe is a device utilizing an evaporation and condensation cycle for transferring heat from a hot or heat input region to a cold or heat output region thereof with minimum temperature drop. One type of heat pipe comprises a closed container within which is included a layer of wicking material saturated with a vaporizable liquid and extending from the heat input region to the heat output region thereof. The addition of heat at the heat input region of the container evaporates the liquid being supplied thereto. The vapor moves to the heat output region of the container where it is condensed. The condensed liquid is returned to the heat input region by capillary action in the wicking material. Such devices are currently being utilized to cool electrical, optical and other devices in which heat is generated.

In such heat pipes condensation of vapor occurs on the exposed surface of the layer of wicking material. Accordingly, the layer of wicking material is filled with condensate and heat rejection must occur by conduction through the total thickness of the layer of wicking material. The low thermal conductivity of the wicking material with liquid contained therein results in a relatively large temperature drop in the transfer of the heat of condensation to the cooled heat pipe wall at the condenser region thereof.

Accordingly, a primary object of the present invention is to provide structure and organization which assures a minimum thickness of fluid layer between condensing vapor and the surface on which condensation takes place and also to provide minimum temperature difference between the condensing surface and the temperature of the condensing vapor.

In carrying out the inventions applied to a heat pipe there is provided a layer of wicking material having a pair of opposed surface portions, one of which is adjacent to and spaced from the internal surface of the condenser wall of the heat pipe. The layer of wicking material includes a multiplicity of capillary passages, each of small cross-sectional area, extending in various directions and to various extents, and interconnected to move liquid therethrough from one surface region to another. The wicking material also includes a plurality of openings each of large cross-sectional area in relation to the cross-sectional area of a capillary passage, and each extending from one surface portion to the opposed surface portion thereof to provide a relatively low impedance path to the passage of vapor therethrough to the surface of the condenser wall. The layer of wicking material is spaced sufficiently close to the wall of the condenser to readily absorb liquid condensate formed thereon.

The features of our invention which we desire to protect herein are pointed out with particularity in the appended claims. The invention itself, however, both as to its organization and method of operation, together with further objects and advantages thereof may best be understood by reference to the following description taken in connection with the accompanying drawings wherein:

FIG. 1 is a cross-sectional view of a heat pipe embodying the present invention.

FIG. 2 is a view of the portion of the heat pipe of FIG. 1 taken along section lines 2—2 of FIG. 1.

FIG. 3 is a developed view of the inside surface of the wicking material of the heat pipe of FIGS. 1 and 2 located in the condenser or heat output section thereof.

FIG. 7 is a cross-sectional view of a heat pipe showing another embodiment of the present invention.

Figure 8:
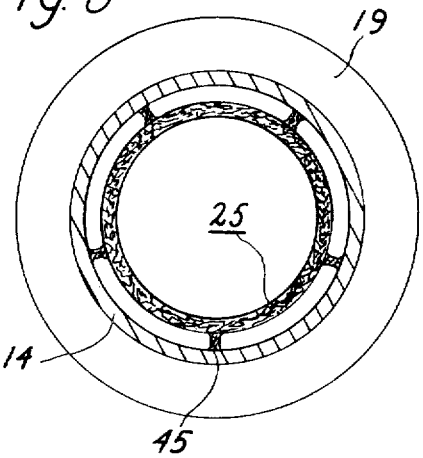
FIG. 8 is a view of the portion of the heat pipe of FIG. 7 taken along section lines 8—8 of FIG. 7.

Referring now to FIGS. 1, 2 and 3, there is shown a chamber 10 formed by an enclosure 11, only part of which is shown, in which is included a device 12, also only part of which is shown. The device 12 generates heat which must be removed therefrom. For such purpose a heat pipe 13 is provided. The heat pipe 13 includes a tubular or cylindrical container 14 of metallic material sealed at its ends by end walls 15 and 16 and having a heat input section 17 at one end thereof. The heat pipe is mounted in an opening in the enclosure 11 with the input section 17 thereof conductively connected to the heat generating device 12 and with the heat output section 18 extending into an outer region which may be the atmosphere 22 to which heat is rejected or transferred. The heat output section of the container is provided with fins 19 to facilitate the dissipation of heat from the output section 18. The heat input section 17 includes an end region of the metallic container 14 in the form of a cylindrical wall 20 and the heat output end includes the other end region of the container in the form of a cylindrical wall 21.

Figure 4:
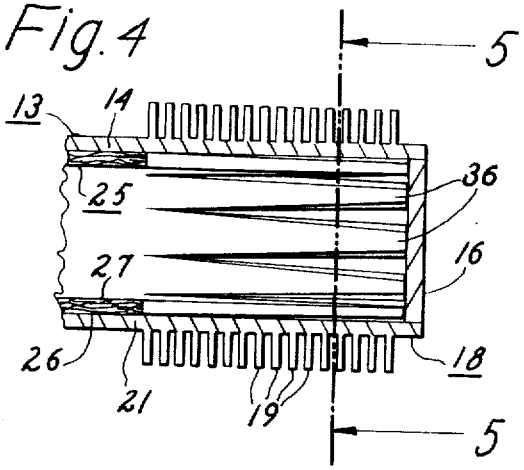
FIG. 4 is a cross-sectional view of the condenser portion of a heat pipe in accordance with another embodiment of the present invention.
Figure 5:
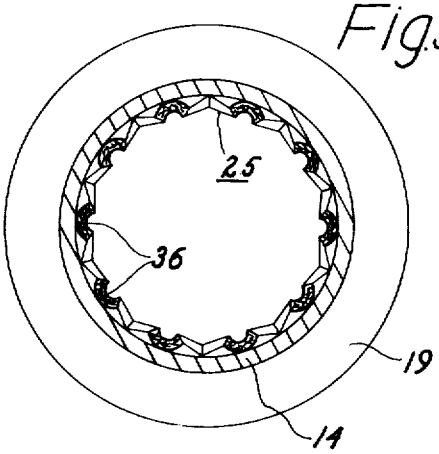
FIG. 5 is a view of the portion of the heat pipe of FIG. 4 taken along section lines 5—5 of FIG. 4.
Figure 6:
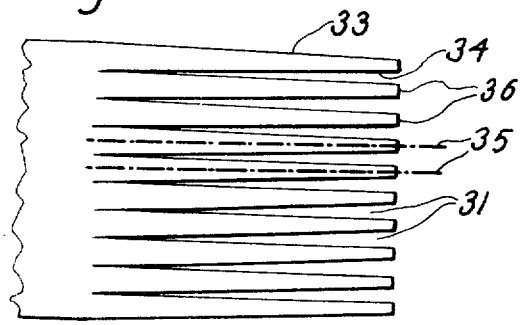
FIG. 6 is a developed view of the inside surface of the wicking material of the heat pipe of FIGS. 4 and 5 located in the condenser or heat output section thereof.

A tubular or cylindrical layer 25 of wicking material having a pair of opposed cylindrical surfaces 26 and 27 is included within the container. A portion of surface 26 of the layer of wicking material is in contact with the inside surface of the wall 20 and another portion of the same surface is in contact with the inside surface of the other wall 21. The wicking material may be made of any of a variety of materials such as sintered metal fibers and non-metallic fibers and includes a multiplicity of capillary passages or pores of small cross-sectional area extending in various directions and to various extents, and interconnected to move liquid therethrough from one surface region thereof to another. A portion of the wicking material in contact with the wall 21 is provided with a plurality of openings in the form of longitudinal slots 31 extending from one surface portion of the layer 25 in contact with the wall 21 to the opposite surface portion thereof. The slots 31 are tapered inwardly from the end of the layer 25 and uniformly spaced with respect to one another about the periphery of the layer 25 over the portion of the wicking material in contact with the wall 21 as shown in FIG. 3. Accordingly, the slots 31 form in the layer 25 a plurality of strips 32 which are tapered along the length thereof toward the outside end of the wall 21. The aggregate or total cross-sectional area of the slots 31 is a substantial portion, shown in FIGS. 1 and 3 as about fifty percent, of the inner surface of the wall 21 of the heat output section. Any vapor passing from the heat input end to the heat output end of the heat pipe readily passes through the slots 31 and contacts the inner surface of wall 21. Accordingly, the temperature drop at the heat output section of the heat pipe is reduced over an arrangement without such provisions. In a device such as described in connection with FIGS. 1, 2 and 3 the temperature drop was reduced to one-third the temperature drop of a device having a continuous or solid layer, i.e., without such cut outs or slots. To provide further exposure of the inside surface of wall 21 to vapor, the sides 33 and 34 of the strips 32 may be spaced from the inside surface of the wall 21 with the strips contacting the inside surface along a longitudinal axes 35 thereof as shown in the embodiment of FIGS. 4, 5 and 6 in which elements corresponding to elements of FIGS. 1, 2 and 3 are designated by the same symbol. The strips 36 of layer 25 may be truncated as shown to provide greater flow capacity at the ends of the strips.

Figure 9:
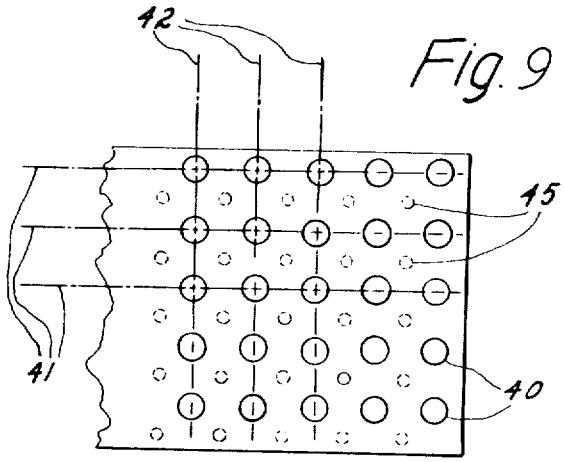
FIG. 9 is a developed view of the inside surface of the wicking material of the heat pipe of FIGS. 7 and 8 located in the condenser or heat output section thereof.

Referring now to FIGS. 7, 8 and 9, there is shown another embodiment of the present invention in which the elements thereof corresponding to elements of FIGS. 1, 2 and 3 are designated by the same symbol. In this embodiment the layer 25 of wicking material adjacent to and in the vicinity of the heat output section is spaced from the inner surface of the wall 21. The portion of the layer 25 of wicking material which is so spaced is provided with a plurality of openings 40 shown in the form of holes or openings of circular cross section extending from one surface portion of the layer 25 to the opposite surface portion thereof. The holes 40 are of uniform diameter and are uniformly spaced with respect to one another as shown in FIG. 9. The holes are centered on the corners of the squares formed by the intersections of one set of equally spaced parallel lines 41 with another set of equally spaced parallel lines 42 orthogonal to the first set. The lines 41 correspond to straight line elements of the surface 27 parallel to the longitudinal axis of layer 25 of wicking material and lines 42 correspond to circular line elements, the planes of which are perpendicular to the longitudinal axis of layer 25. The spacing of adjacent lines in each set are the same; accordingly, the basic figure of the pattern of lines is a square. The cross-sectional area of an opening 40 is relatively large in relation to the mean cross-sectional area of a capillary tube or pore of the layer. Accordingly, any vapor passing from the heat input end to the heat output end of the heat pipe readily passes through the openings 40 and contacts the inner surface of the wall. A plurality of spacers 45 which may be mechanically secured to the layer 25 by intertwining the fibers thereof with the fibers of the layer are provided between the layer 25 of wicking material and the wall 21 to support that portion of the layer of wicking material adjacent to the wall 21 in spaced relationship thereto. The spacers 45 are made of wicking material and consequently also function to transport liquid from the condenser surface to the body of the layer of wicking material. The spacers are particularly useful in absorbing films of condensate on the surface of the wall 21. Accordingly, as liquid droplets, condensed directly on the cooled surface, increase in size, they touch the wick structure and by capillary action are drawn into the wick. Consequently, a bare surface for condensation is maintained with conduction only through a very thin liquid film and high heat transfer coefficients are achieved. In the event that the condensate forms on the bare surface in a thin liquid film, the spacers 45 of wick material facilitate liquid transport into the main wick structure. The spacing of the layer 25 of wicking material from the wall 21 should be just a small distance so that as fluid condenses it can readily be absorbed into the body of the wicking material. At the same time it should not be so close as to permit liquid to build up in the wicking material and consequently obstruct the flow of vapor to the condenser surface. The aggregate cross-sectional area of the openings is a substantial portion of the area of one of the opposed surfaces in contact with the condenser wall 21. The openings are orthogonal to the surface to provide the shortest path from the interior of the heat pipe to the condensing surface of the wall 21.

The layer 25 of wicking material is saturated with a vaporizable liquid such as water, a hydrocarbon or fluorocarbon liquid depending on the use to which the heat pipe is to be put. Accordingly heat applied to the input wall 20 causes liquid in contact therewith to change to a vapor which passes through the layer of wicking material to the space above the layer and in response to the pressure created thereby, the vapor moves to the region adjacent to the other wall 21 where the vapor is condensed into a liquid. The liquid contacts the layer 25 wicking material and is returned by capillary pressure produced therein to the input wall 20. The portion of the layer of wicking material in contact with the heat input section or wall 20 may be provided with structure such as described and claimed in a copending application filed concurrently herewith, Ser. No. 124,806, filed Mar. 11, 1971, and issued as U.S. Pat. No. 3,828,849, and assigned to the assignee of the present invention, in place of the structure shown in FIGS. 1 and 7.

The cut outs or large openings in the form of holes and slots in the wicking material at the heat output section of the heat pipe will allow use of nonmetallic wicking materials such as fiberglass, nylon, polyester, or natural fibers, felted or woven together. Since nonmetallic wicks will have somewhat higher thermal impedances to heat flow in the condenser end of a heat pipe than metallic wicks of the same size and thickness, they would not normally be well suited for use in a heat pipe. The cut outs or openings will, however, bypass the wick, and allow condensation directly on the heat pipe wall. The impedance of the evaporator section is only weakly dependent on wicking material. Hence cut outs at the condenser section make possible performance of non-metallic wicks comparable to performance of metallic wicks.

While the invention has been described in specific embodiments, it will be appreciated that modifications may be made by those skilled in the art and we intend by the appended claims to cover all such modifications and changes as fall within the true spirit and scope of the invention.

What we claim as new and desire to secure by Letters Patent of the United States is:

1. In a heat pipe structure, the combination of a first elongated hollow body of relatively low thermal impedance, said first body being sealed at opposite ends thereof and having an inside wall surface and an outside wall surface, said first body with a heat input section including one end region thereof and with a heat output section including the other end region, said first body having an elongated chamber therewithin extending coaxially therewith from one sealed end thereof to an opposite sealed end thereof, said chamber being bounded by said inside wall surface of said first hollow body, a second elongated hollow body of wicking material situated in said chamber, said second body being open at opposite ends thereof, said wicking material having a thermal impedance which is greater than that of said first body, said second hollow body having an inside wall surface in contact with said chamber and an outside wall surface contacting the inside wall surface of said first body, said second elongated body of wicking material having at least one truncated elongated slot therein extending from one open end of said second body in a direction toward the opposite end of said second body within the heat output section of the first body so as to expose an elongated area of the inside wall surface of the heat output section of said first body, the elongated area so exposed extending from one sealed end of said first body in a direction toward the opposite end of said first body with the heat output section thereof, and a vaporizable liquid occupying at least said chamber of said first body.

2. The combination according to claim 1 further comprising additional elongated slots in said wicking material extending from said same open end of said second body toward the opposite end of said second body.

3. The combination according to claim 2 wherein each of said elongated slots are tapered such that each slot is wider at said one open end of said second body and becomes narrower as the slot extends longitudinally in a direction toward said opposite end of said second body.

* * * * *